United States Patent [19]

Schroeder

[11] 4,260,077

[45] Apr. 7, 1981

[54] DUAL SEPARABLE DISPENSER

[75] Inventor: William Schroeder, Van Nuys, Calif.

[73] Assignee: Aelco Corporation, Van Nuys, Calif.

[21] Appl. No.: 81,645

[22] Filed: Oct. 4, 1979

[51] Int. Cl.[3] ..... B67D 5/42

[52] U.S. Cl. ..... 222/137; 128/218 M; 206/820; 206/366; 220/23.4; 222/143

[58] Field of Search ..... 206/820, 366; 220/23.4; 128/218 R, 218 M; 222/135, 136, 137, 143, 386, 145

[56] References Cited

U.S. PATENT DOCUMENTS

| | | | |
|---|---|---|---|
| 3,194,426 | 7/1965 | Brown, Jr. | 222/143 X |
| 3,269,389 | 8/1966 | Meurer et al. | 222/135 X |
| 3,311,265 | 3/1967 | Creighton; Jr. et al. | 222/137 |
| 3,467,096 | 9/1969 | Horn | 128/218 R |
| 3,767,085 | 10/1973 | Cannon et al. | 222/137 X |
| 3,828,980 | 8/1974 | Creighton et al. | 222/137 |
| 3,917,120 | 11/1975 | Larenz et al. | 206/820 X |

FOREIGN PATENT DOCUMENTS

| | | | |
|---|---|---|---|
| 1442465 | 5/1966 | France | 206/820 |
| 498467 | 9/1954 | Italy | 128/218 M |

*Primary Examiner*—David A. Scherbel
*Attorney, Agent, or Firm*—Vernon D. Beehler

[57] ABSTRACT

A dual type dispenser for dispensing two materials in equal quantities consists of two barrels joined together and a plunger for each barrel. Since occasions may arise when the barrels are to be used separately, the junction between the barrels is separable, as by a sliding interlock. The plungers also, although initially attached together at the handle to make certain they are moved together, are arranged to be broken apart for use separately with the separated barrels.

6 Claims, 10 Drawing Figures

DUAL SEPARABLE DISPENSER

Semi-soft materials to be dispensed in relatively small quantities have traditionally been packaged in tubes of soft material which can be squeezed and collapsed as the volume of material progressively diminishes during use. Typical of such products are glue, sealant, toothpaste, and the like. More recently, with the advent of new adhesives, such for example, as the currently popular epoxies, it becomes necessary to dispense complementary materials, mixed together as needed to activate them. The nature of this material is such that the separate ingredients must be kept apart to avoid hardening while being stored, as well as having the capability of being readily dispensed in preferably equal quantities immediately prior to mixing and use.

On those occasions where the materials need not be measured in carefully proportioned quantities, it has been the practice to merely provide a twin pack of tubes leaving it to the user to squeeze out equal quantities of the different materials. Even though this may result in a satisfactory mix for adhesive purposes, there is customer resistance to such twin packs when, solely because of customer inadvertence, one tube becomes exhausted before the other.

To satisfy this need, some dual dispensers have been developed, usually of hard material with dual plungers arranged to be operated simultaneously in the interest of dispensing carefully measured equal quantities of the material from two tubes. Although such practice satisfies some needs, purely from the point of view of the consumer, other problems are encountered for the packagers including the need for specialized equipment in filling two such connected tubes with different materials which must be kept carefully separated.

Also, in a highly competitive market, costs are an important consideration, one of which is the very high cost of the first mold, or successive molds, which is the only acceptable way of making end products of synthetic plastic material. When the versatility of such molds is not such that they can be changed slightly to accomodate different circumstances, the mold cost becomes a very material cost factor.

It is therefore among the objects of the invention to provide a new and improved dual separable dispenser, for dispensing equal quantities of different materials simultaneously, and wherein one container is readily separable from the other either before filling, after filling, or whenever occasion might require.

Another object of the invention is to provide a new and improved dual separable dispenser which is of such character that it can be built in different sizes while adopting the same principle of separating one dispenser from the other.

Still another object of the invention is to provide a new and improved dual separable dispenser wherein both the barrels or containers of the dispenser can be separated and also wherein the plungers likewise can be separated, but wherein when in dual assembled position, there is no shifting of one of the dual parts with respect to the other.

Still another object of the invention is to provide a dual separable dispenser of such character that it can be readily molded with dual parts so joined together that the parts can be cleanly separated into single parts of such character and finished appearance as to be marketable individually.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

FIG. 1 is an end view of the device.

Figure 2:
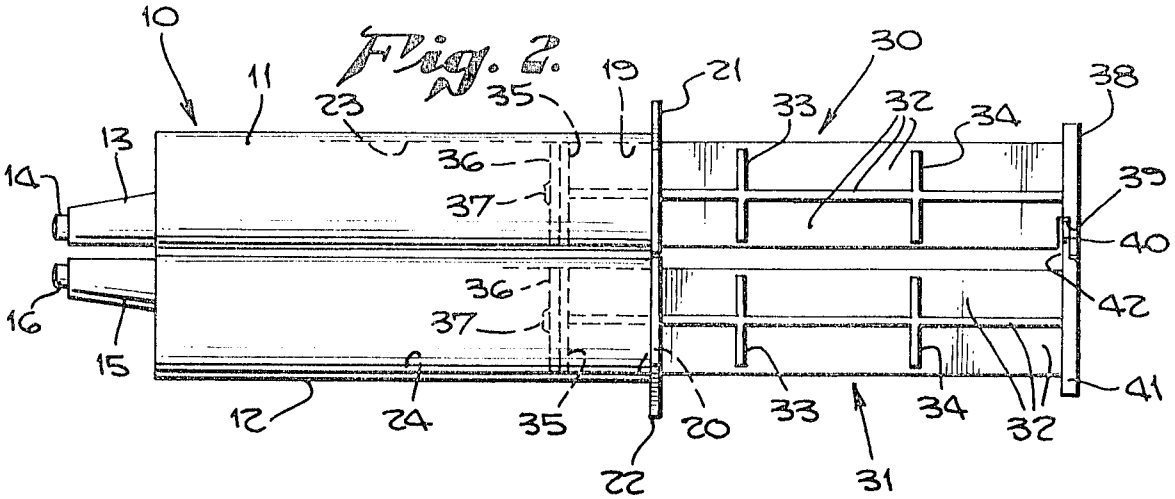
FIG. 2 is a side elevational view.
Figure 4:
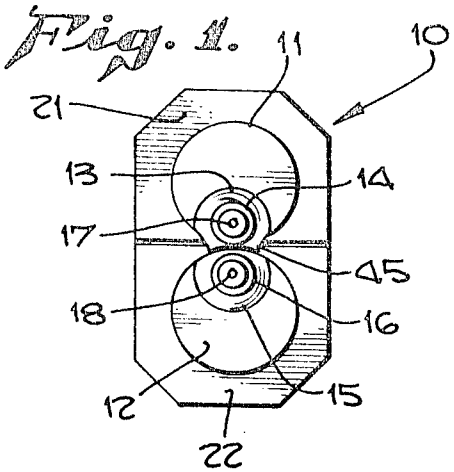
FIG. 4 is a longitudinal sectional view of the device in emptied condition.
Figure 3:
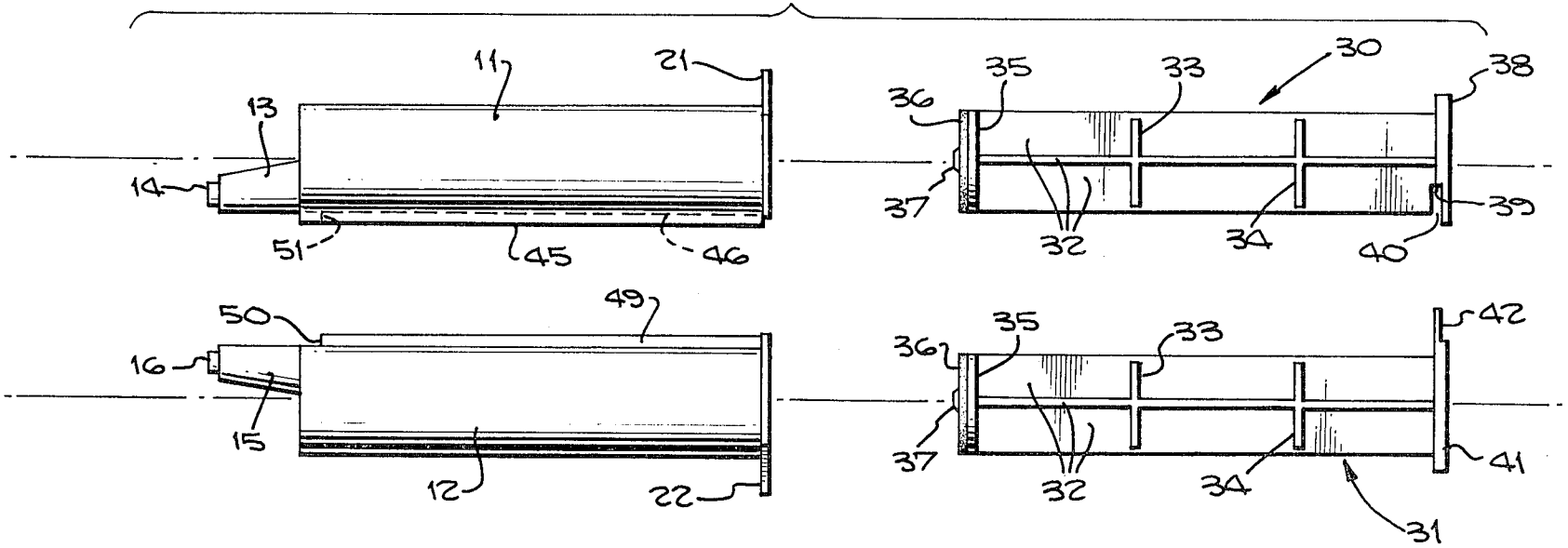
FIG. 3 is an exploded view in side elevation.
Figure 4:
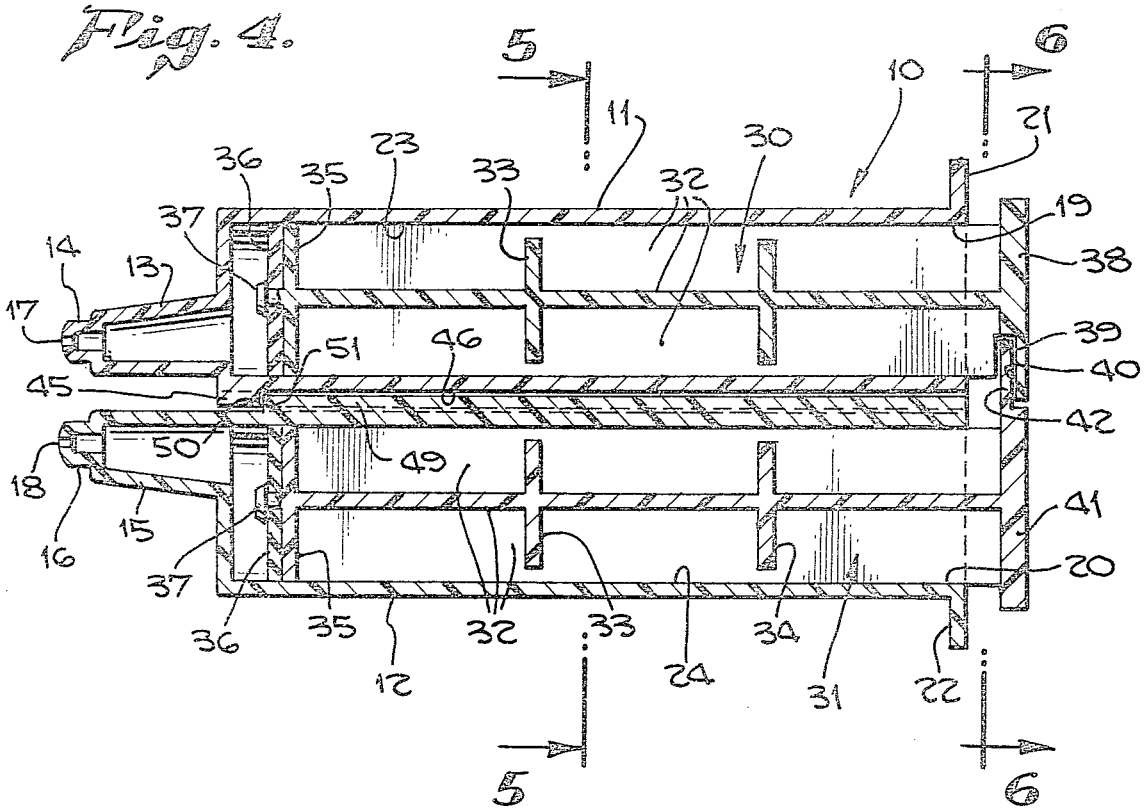

In an embodiment of the invention chosen for the purpose of illustration there is shown a dual separable dispenser indicated generally by the reference character 10 consisting in the main of two barrels 11 and 12. The barrels are complementary with respect to each other, the barrel 11 having a spout 13 terminating in a nozzle 14 and the barrel 12 having a spout 15 terminating in a nozzle 16. The spouts are positioned on one side of the respective barrel so that in the assembled position shown, the spouts are side by side in close association with each other. The nozzles provide respective holes 17 and 18 by which the contents of the barrels are dispensed.

At the opposite end of the barrel 11 is an opening 19. An opening 20 is provided for the barrel 12. Surrounding the opening 19 is a relatively wide flange 21. A similar wide flange 22 surrounds the opening 20. Within the barrel 11 is a chamber 23 communicating at one end with the opening 19 and at the other end with the hole 17. Similarly there is a chamber 24 in the barrel 12 in communication respectively with the opening 20 and the hole 18.

For cooperation with the barrel 11 there is a plunger 30 and a similar plunger 31 is for cooperation with the barrel 12. Assuming the plunger 30 to be made, for example, of a currently available synthetic plastic resin material, as are also the barrels, the plunger is stiffened by longitudinally extending reinforcing and stiffening webs 32, and transversely extending reinforcing and stiffening webs 33 and 34.

At the end of the plunger 30 is a disc 35 against which rests a washer 36, centered by means of a button 37. The plunger 31 is correspondingly constructed. At the opposite end of the plunger 30 is a flange 38 which protrudes laterally from the plunger on three sides. On the fourth or inner side there is provided a step 39 forming a recess 40. A flange 41 for the plunger 31 is correspondingly shaped but at the inside edge is provided with a projection 42 adapted to be slidably received within the recess 40 of the plunger.

Figure 5:
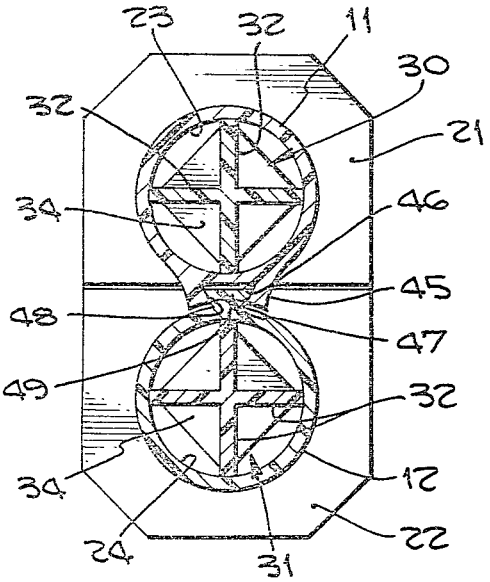
FIG. 5 is a cross sectional view on the line 5—5 of FIG. 4.
Figure 6:
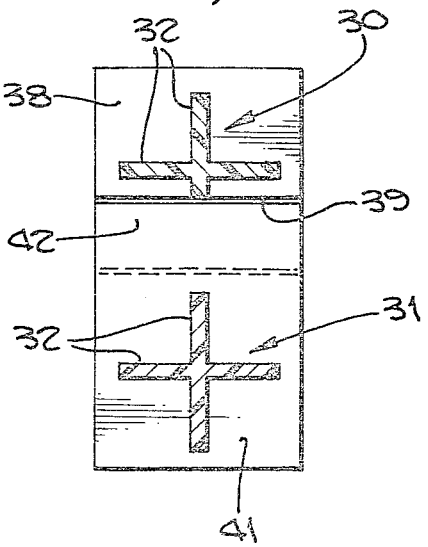
FIG. 6 is a cross sectional view on the line 6—6 of FIG. 4.
Figure 7:
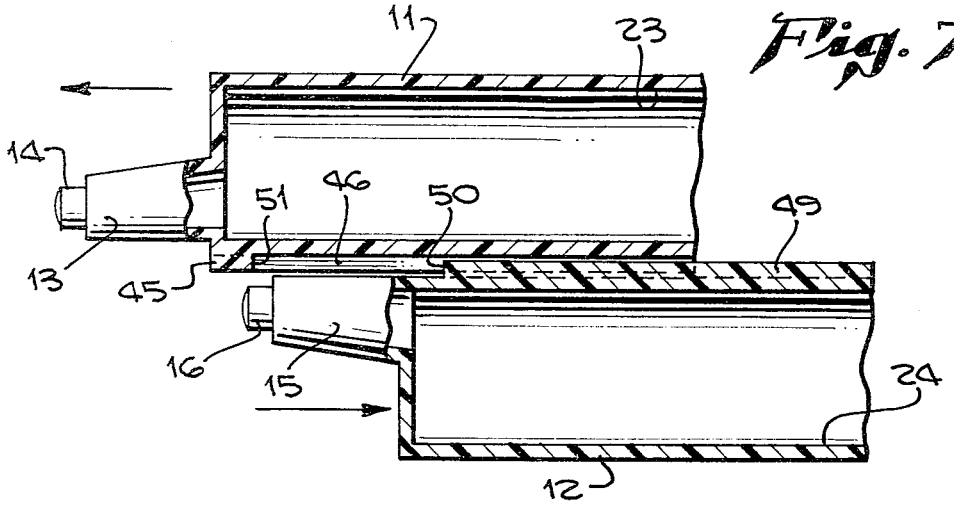
FIG. 7 is a fragmentary longitudinal sectional view showing partial engagement of two portions of the device.

In the form of the device just described, each of the barrels 11 and 12 and corresponding plunger 30 and 31 can be molded separately but are so constructed that they can be joined together to form a dual dispenser in an arrangement such as that shown in FIGS. 1, 2, 4 and 5. To make this possible there is provided for the barrel 11 a longitudinally extending enlargement 45 within which is formed a longitudinally extending slot 46 with undercut side walls 47 and 48. In cooperation with the slot 46 is a longitudinally extending projection 49 on the adjacent side of the opposite barrel 12. The longitudinally extending projection 49 has a cross sectional shape complementary with respect to the cross sectional shape of the slot 46, as best shown in FIG. 5.

When the projection 49 is to be slid into engagement with the slot 46, an end shoulder 50 is started into the slot 46 and moved inwardly until the shoulder reaches an abutment 51. Engagement of the shoulder with the abutment fixes the endwise sliding movement of one barrel with respect to the other so that once assembled they retain the positions of FIGS. 2 and 4.

After the barrels 11 and 12 have been filled, the respective plungers 30 and 31 are started into the corresponding chambers 23 and 24. In the initial stage opposite ends of the plungers 30 and 31 are moved together so that the projection 42 is extended into the recess 39. Once the projection 42 is thus positioned, the two plungers 30 and 31 will act in concert moving together at precisely the same rate whether being pushed inwardly or withdrawn outwardly. The projection 42 is retained in engagement with the recess 40 by reason of the fact that the plungers are in substantially fixed slidable position in the chambers 23 and 24.

With the parts so constructed and assembled in the positions as described, the barrels are held together in side by side position and when filled with complementary charges of material, equal quantities of the respective materials are discharged from the holes 17, 18 in the nozzles 14, 16, as the plungers 30 and 31 are moved at equal distances into the chambers 23 and 24. During this movement the plungers are attached to each other by engagement of the projection 42 with the recess 40 so that the plungers 30 and 31 move in unison. Equal lengths of the contents of the barrels are projected and this will mean equal quantities if the sizes of the holes 17 and 18 are equal. Should there be need for dispensing different relative quantities of material, the sizes of the chambers and sizes of the corresponding holes could be changed.

On those occasions when a single dispenser might be needed, the barrels, and their corresponding plunger, can be kept separately and used separately. On the other hand, though once assembled there might thereafter be use for the dispensers separately. The barrels can be disconnected by disengaging the projection 49 from the slot 46 and the plungers 30 and 31 also disengaged by withdrawal of the projection 42 from the recess 40.

Figure 8:
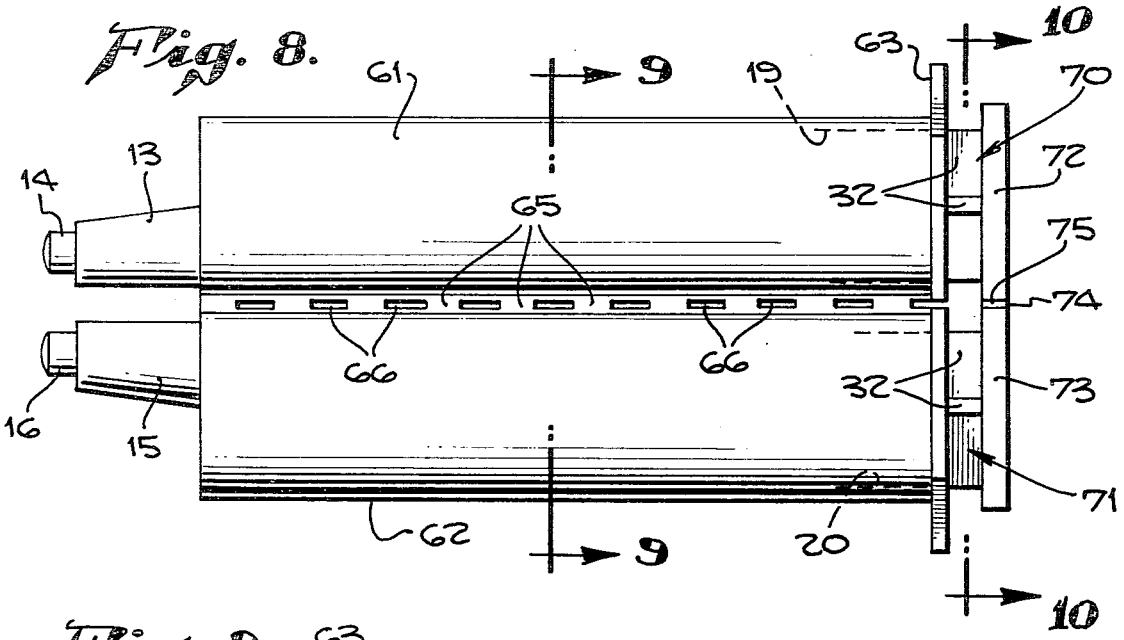
FIG. 8 is a side elevational view of a second form of the device.
Figure 9:
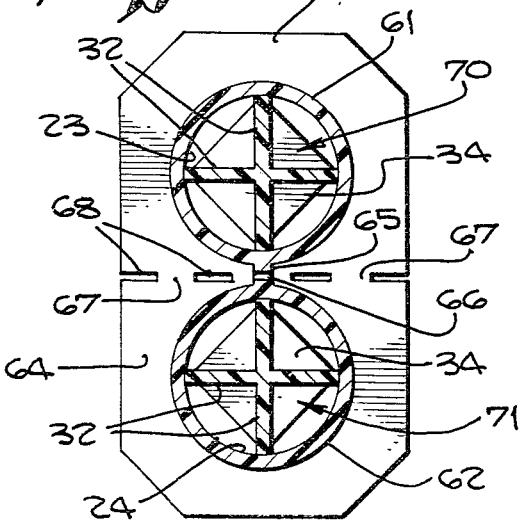
FIG. 9 is a cross sectional view on the line 9—9 of FIG. 8.
Figure 10:
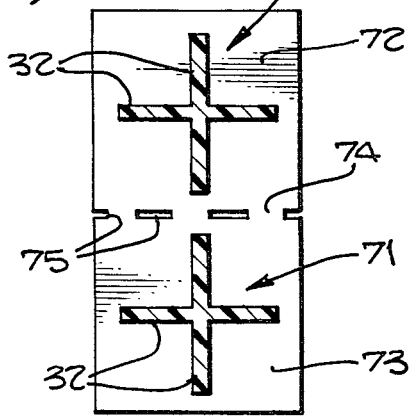
FIG. 10 is a cross sectional view on the line 10—10 of FIG. 8.

In a second form of the device illustrated in FIGS. 8, 9 and 10, barrels 61 and 62 are shown in fixed parallel relationship capable of being broken apart. In other respects the barrels are much the same as the barrels 11 and 12 being provided with nozzles 14, 16 and spouts 15, 17. Flanges 63 and 64 are at the opposite ends. In this form of the device there is a web 65 interconnecting adjacent sides of the barrels 61 and 62, the web being weakened by provision of rectangular perforations 66. Similarly there is an area 67 joining the flanges 63 and 64 also provided with perforations 68. On this occasion the barrels can be effectively separated one from another by merely breaking them apart along the lines of the perforations whereupon the barrels can be used separately.

Since, however, it is necessary that plungers 70 and 71 act together when assembled in dual relationship, a flange 72 for the plunger 70 is joined to a flange 73 for the plunger 71 at a common adjacent area 74. This area is weakened by rectangular perforations 75 so that these flanges also can be broken apart along this fracture line. As a consequence, each barrel and its plunger is a complete single dispenser whether for filling, dispensing, or both. Unlike the first described form of the invention, the second form cannot be readily reassembled to serve in a twin capacity as can the first described form.

While particular embodiments of the present invention have been shown and described, it will be obvious to those skilled in the art that changes and modifications may be made without departing from the invention in its broader aspects, and therefore, the aims of its appended claims is to cover all such changes and modifications as fall within the true spirit and scope of this invention.

Having described the invention, what is claimed as new in support of Letters Patent is as follows:

1. A dual separable dispenser for simultaneously dispensing two materials comprising a pair of single piece barrels of substantially equal length, each barrel having an outflow orifice at one end and an opening at the opposite end, there being a separable connection between the barrels along adjacent sides holding the barrels in fixed laterally spaced parallel relationship with outflow orifices adjacent each other, a single piece plunger for each barrel, and a separable attachment between said plungers holding said plungers together in fixed laterally spaced relationship at one end of each while respective opposite ends are in sliding position in the corresponding barrels, said barrels being parallel to each other with said barrels and said plungers being separable to allow each barrel and the respective plunger to be operated individually, the separable connection between the barrels comprising a web in a space between the barrels with perforations intermediate opposite sides of the web forming a fracture area whereby to leave stiffening portions of the web on the respective barrels after fracture.

2. A dual separable dispenser for simultaneously dispensing two materials comprising a pair of single piece barrels of substantially equal length, each barrel having an outflow orifice at one end and an opening at the opposite end, there being a separable connection between the barrels along adjacent sides holding the barrels in fixed laterally separated parallel relationship forming a space therebetween with outflow orifices adjacent each other, a single piece plunger for each barrel, and a separable attachment between said plungers holding said plungers together in fixed laterally spaced relationship at one end of each while respective opposite ends are in sliding position in the corresponding barrels, said barrels being parallel to each other with said barrels and said plungers being separable allow each barrel and the respective plunger to be operated individuallv, the separable connection between the barrels being in said space and comprising a pair of complementary sliding members, each member being integrally formed with the respective barrel extending radially outwardly from the respective barrel and providing a stiffening means between the barrels throughout the length of said barrels.

3. A dual separable dispenser as in claim 2 wherein the separable connection between the barrels comprises a single track on one barrel and a single shoe on the other barrel slidable in said track and extending throughout the length of the barrels along the most closely adjacent side portions of said barrels.

4. A dual separable dispenser as in claim 2 wherein there is an interlock between said barrels at optimum aligned positions relative to each other.

5. A dual separable dispenser for simultaneously dispensing two materials comprising a pair of single piece barrels of substantially equal length, each barrel having an outflow orifice at one end and an opening at the opposite end, there being a separable connection between the barrels along adjacent sides holding the barrels in fixed laterally spaced parallel relationship with outflow orifices adjacent each other, a single piece plunger for each barrel, and a separable attachment between said plungers holding said plungers together in fixed laterally spaced relationship at one end of each while respective opposite ends are in sliding position in the corresponding barrels, said barrels being parallel to each other with said barrels and said plungers being separable to allow each barrel and the respective plunger to be operated individually, the separable attachment between the plungers comprising portions of flanges on the respective plungers with perforations between said portions of the flanges forming a fracture area.

6. A dual separable dispenser for simultaneously dispensing two materials comprising a pair of single piece barrels of substantially equal length, each barrel having an outflow orifice at one end and an opening at the opposite end, there being a separable connection between the barrels along adjacent sides holding the barrels in fixed laterally spaced parallel relationship with outflow orifices adjacent each other, a single piece plunger for each barrel including integrally formed separable attachment between said plungers holding said plungers together in fixed laterally spaced relationship at one end of each while respective opposite ends are in sliding position in the corresponding barrels, said barrels being parallel to each other with said barrels and said plungers being separable to allow each barrel and the respective plunger to be operated individually, each plunger having a portion at a location radially outward of a longitudinal center line, a relatively flat flange at the end of each plunger where the plungers are joined together, each said flange being anchored to an end of the respective plunger and said portion whereby to stiffen the flange and wherein said separable attachment between the plungers forming a transversely slidable interlocking attachment of one flange with respect to the other.

* * * * *